US008047113B2

(12) United States Patent
Nilsen

(10) Patent No.: US 8,047,113 B2
(45) Date of Patent: Nov. 1, 2011

(54) GUIDE FOR HAND-HELD POWER TOOL

(76) Inventor: Chris D. Nilsen, Cotati, CA (US)

( * ) Notice: Subject to any disclaimer, the term of this patent is extended or adjusted under 35 U.S.C. 154(b) by 282 days.

(21) Appl. No.: 11/306,173

(22) Filed: Dec. 19, 2005

(65) Prior Publication Data

US 2007/0137446 A1 Jun. 21, 2007

(51) Int. Cl.
*B27B 11/00* (2006.01)

(52) U.S. Cl. ..... 83/743; 83/613; 83/746; 30/371

(58) Field of Classification Search ..... 83/745, 83/743, 613, 614, 454, 455, 746, 761, 821; 30/370–374
See application file for complete search history.

(56) References Cited

U.S. PATENT DOCUMENTS

| | | | | |
|---|---|---|---|---|
| 3,344,824 | A | 10/1967 | Greco | |
| 3,368,594 | A | 2/1968 | Drumbore | |
| 3,410,324 | A | 11/1968 | Thompson | |
| 3,739,678 | A | 6/1973 | Kankaanpaa | |
| 3,983,776 | A | 10/1976 | Flanders | |
| 4,050,340 | A | 9/1977 | Flanders | |
| 4,202,233 | A * | 5/1980 | Larson | 83/745 |
| 4,945,799 | A | 8/1990 | Knetzer | |
| 5,035,061 | A * | 7/1991 | Bradbury et al. | 33/430 |
| 5,647,420 | A | 7/1997 | Michell | |
| 6,173,631 | B1 | 1/2001 | Schock | |
| 2004/0010926 | A1 * | 1/2004 | Hampton | 30/374 |
| 2005/0016349 | A1 | 1/2005 | Molburg | |

* cited by examiner

*Primary Examiner* — Phong Nguyen
(74) *Attorney, Agent, or Firm* — Patent Law Offices of Michael E. Woods; Michael E. Woods

(57) ABSTRACT

An apparatus and method for a solution that permits a carpenter to make exact, on-the-spot time-efficient cross-cuts of their boards while holding the board in one-hand and the circular saw in the other hand. A cross-out apparatus includes a guide system including a housing and a range of motion control for defining a processing path for a guide element as it moves from a first position to a second position relative to the housing; a workpiece coupler, coupled to the guide element, for defining a desired processing orientation with respect to a workpiece for maintaining the desired processing orientation as the guide element moves from the first position to the second position; and an attachment system, coupled to the housing, for cooperating with a hand-held power processing tool to position a processing implement at a reference location relative to the workpiece and at the desired processing orientation, the attachment system coupled to the housing so the guide element maintains the desired processing orientation along the processing path from the reference location during use of the hand-held power processing tool to process the workpiece.

6 Claims, 3 Drawing Sheets

GUIDE FOR HAND-HELD POWER TOOL

BACKGROUND OF THE INVENTION

The invention relates generally to processing guides used in cooperation with hand-held power tools, and more specifically to a cross-cut guide for a hand-held circular saw.

Home construction in the United States produces an enormous range of house styles that include an enormous range of finishing styles. Even so, it is true that a huge majority of these homes are built using completely standardized building practices. Partially this is because building codes across the United States are mostly uniform, and also because the use of standard building practices permit reliable housing to be quickly constructed at a lower cost than would be the case without the standardization. The construction sequence, especially of a brand new home, typically includes most the following steps: grading/site preparation, foundation construction, framing, window/door installation, roofing, siding, rough electrical, rough plumbing, rough HVAC, insulation, drywall, underlayment, trim, painting, finish electrical, bathroom/kitchen counters/cabinets, finish plumbing, carpet and flooring, finish HVAC, water main/well drilling, sewer hookup/septic installation, and a punch list.

Construction framing, particularly for human-occupied buildings, commonly uses wooden framing materials also called boards, such as 2×4s (1.5" by 3.5") and 2×10s (1.5" by 9.5") that come in many lengths but each are usually at least about 8 feet long. The boards are purchased too long for most uses and they must be individually cut to size. The framing of the floor, the walls, the ceiling, and the roof require that a carpenter individually cut many boards to exact size. The preferred method is to have the boards cut on location to the precise length. For speed and efficiency, each board is individually measured using a tape measure to mark the cut location. The carpenter then holds the board in one hand and makes a cross-cut using a hand-held circular saw (e.g., a Skillsaw circular saw). The carpenter must try to maintain a right-angle during the cut while holding the board and operating the saw. Results can vary considerably in maintaining a right-angle cut at the desired location for a single board, much less hundreds of boards.

One solution employed by many construction framing crews is the use of a square that is used to mark a right-angle across the board at the correct location, with the line providing a visual guide to the carpenter during the cut. This improves the right angle cuts but it requires use of another tool and is therefore slower. Also the line for the cut is not constrained to the visual cue, thus the conformance of the final cut to the desired angle is not always as close as the carpenter would like.

It is therefore desirable to provide a solution that permits a carpenter to make exact, on-the-spot time-efficient cross-cuts of their boards while holding the board in one-hand and the circular saw in the other hand.

BRIEF SUMMARY OF THE INVENTION

Disclosed is an apparatus and method for a solution that permits a carpenter to make exact, on-the-spot time-efficient cross-cuts of their boards while holding the board in one-hand and the circular saw in the other hand. The apparatus includes a guide system including a housing and a range of motion control for defining a processing path for a guide element as it moves from a first position to a second position relative to the housing; a workpiece coupler, coupled to the guide element, for defining a desired processing orientation with respect to a workpiece for maintaining the desired processing orientation as the guide element moves from the first position to the second position; and an attachment system, coupled to the housing, for cooperating with a hand-held power processing tool to position a processing implement at a reference location relative to the workpiece and at the desired processing orientation, the attachment system coupled to the housing so the guide element maintains the desired processing orientation along the processing path from the reference location during use of the hand-held power processing tool to process the workpiece.

The method includes a) positioning a processing implement of a hand-held power processing tool at a reference location relative to a workpiece using an apparatus cooperating with the power processing tool, the apparatus including: a guide system including a housing and a range of motion control for defining a processing path for a guide element as it moves from a first position to a second position relative to the housing; a workpiece coupler, coupled to the guide element, for defining a desired processing orientation with respect to the workpiece for maintaining the desired processing orientation as the guide element moves from the first position to the second position; and an attachment system, coupled to the housing, for cooperating with the hand-held power processing tool to position the processing implement at the reference location relative to the workpiece and at the desired processing orientation, the attachment system coupled to the housing so the guide element maintains the desired processing orientation along the processing path from the reference location during use of the hand-held power processing tool to process the workpiece; and b) processing the workpiece from the reference location and at the processing orientation using the processing tool guided by the apparatus all along the processing path.

In the preferred embodiment, the power processing tool is a hand-held circular saw (e.g., Skillsaw brand or the like) that includes a rotating cutting blade designed for cutting workpieces like framing materials and the like. In the most preferred embodiment, the system provides a cross-cut (e.g., about ninety degrees to the longitudinal axis of a 2×4 framing board) while the user holds the workpiece in one hand and operates the saw with another hand.

The embodiments provide a solution that permits a carpenter to make exact, on-the-spot time-efficient cross-cuts of their boards while holding the board in one-hand and the circular saw in the other hand. When using this device, all the operator needs is a reference of where to trim/cut the workpiece. The user does not need to use another tool to create a reference line, nor do they need to attach anything to the workpiece to ensure that the resulting cut is accurate, both in location and reproductive of the desired cutting angle.

DETAILED DESCRIPTION OF THE INVENTION

The present invention relates to a solution that permits a carpenter to make exact, on-the-spot time-efficient cross-cuts of their boards while holding the board in one-hand and the circular saw in the other hand. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
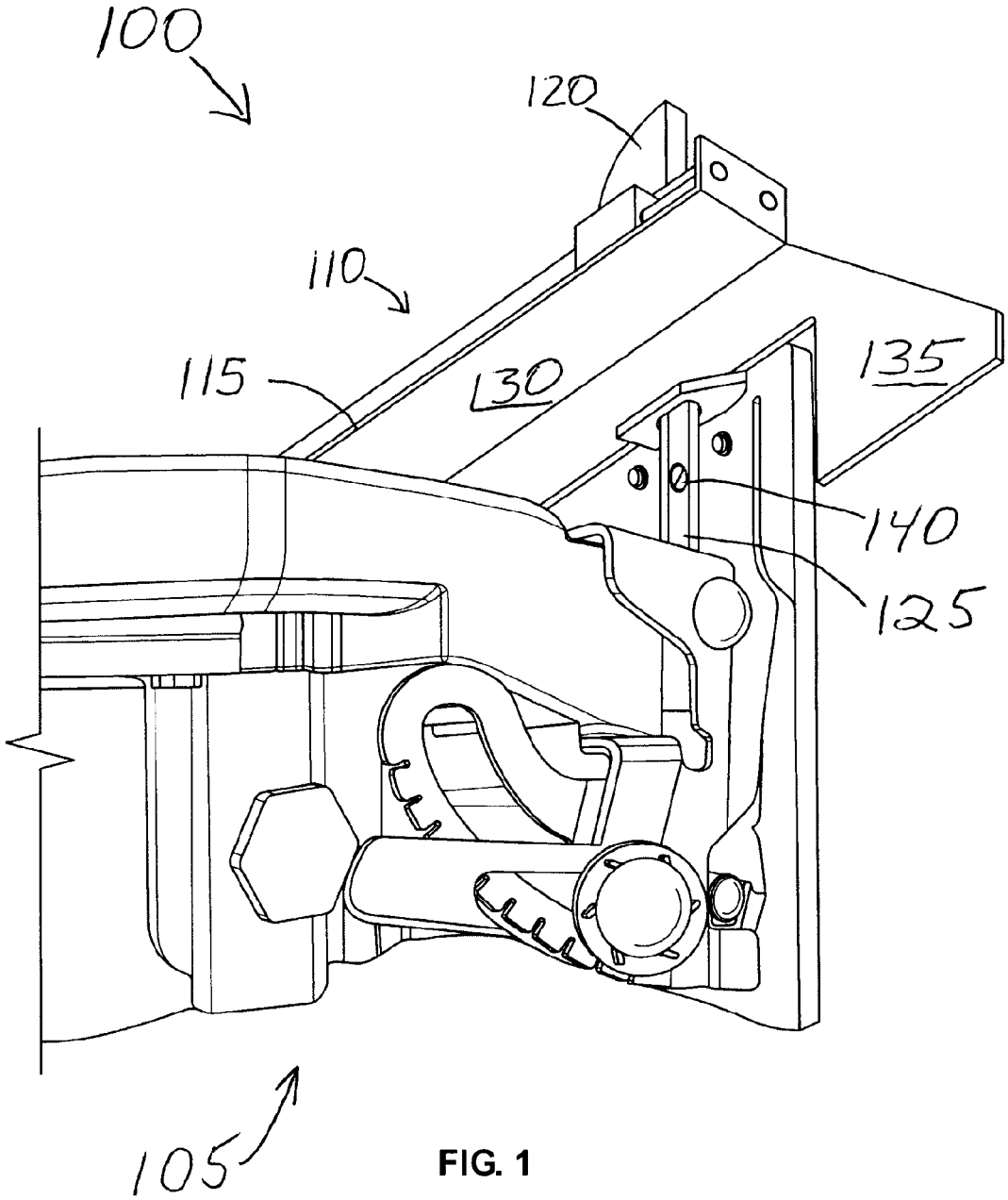
FIG. 1 is a top plan view of a guided cutting system according to a preferred embodiment of the present invention.

FIG. 1 is a top plan view of a guided cutting system 100 according to a preferred embodiment of the present invention. System 100 includes a hand-held power processing tool 105 to having a guide 110 cooperated. To simplify the following discussion, the preferred embodiment using a hand-held circular power saw to trim framing studs will be shown. Thus, power processing tool 105 is a Skillsaw® circular saw and the like and the workpiece is a 2×4 framing stud that is cut by the circular saw at a desired angle (for most applications this is perpendicular to the 2×4 longitudinal axis—substantially a right angle). However, the invention is broader than this and applies to a wide range of hand-held power processing tools such as other saw types (e.g., a jigsaw having a reciprocating cutting blade as opposed to a rotating blade), other "cutting" tools (e.g., a router having a different type of rotating cutting blade for cutting wooden materials), and other tools that have an implement that performs a function on a workpiece (e.g., a paint sprayer that has a nozzle ejecting paint onto the surface of the workpiece). Not only may the type of power processing tool vary, the nature of the guide appropriate to the tool and/or task may also vary. For example, while the preferred embodiment performs right-angle cuts as the preferred processing orientation, other embodiments may provide for other angles, or permit the user to select a desired angle. Additionally, in some embodiments and implementations, it may be desirable to provide for a processing path that is not linear throughout a range of motion of the guiding system. Guide 110 is designed to facilitate a straight cut at a desired reference location at the desired cutting angle. For some applications and tools other desirable paths may include ellipses, chords, and other non-linear paths.

Guide 110 of the preferred embodiment includes three major components: a guide system 115, a workpiece coupler 120, and an attachment system 125. Guide system 115 defines the processing path through a range of motion. Workpiece coupler 120 engages the workpiece and maintains the desired relationship of guide 110 to the workpiece throughout the range of motion. Attachment system 125 cooperates guide 110 to tool 105 to position a processing implement of tool 105 at the desired reference location and to maintain the desired processing orientation of the processing implement throughout the range of motion. In the case of the circular saw, the cutting blade of the saw is constrained to be a linear, right-angle cut starting from the reference location throughout the entire cut of trimming off an end of the 2×4. Attachment system 125 in this case is a slender rod that is sized to match a receptacle in the saw. Circular saws have a standard guide attachment used as a rip-guide. A rip-guide, in contrast to the cross-cut guide, is used to make a cut generally parallel to the longitudinal axis of the piece of lumber, Rip-guides are commonly used to trim plywood sheeting for example. The rip-guide in this case is a fence on the end of an attachment rod that engages the rip-guide slot on the saw. A rip guide attachment is not workable for the present solution as it common for the cross-cut to be many feet (e.g., 7.5 feet) from the end of the 2×4. A rip-guide would thus need to be 7.5 feet long while trying to maintain a cut parallel to an edge only 3.5 inches long. The guide would make the tool unwieldy and the cut would unlikely be parallel to the edge (end) of the 2×4. Further, making different angle cuts would not be possible.

In the preferred embodiment, a housing of guide system 115 includes a housing 130 having an index 135. Index 135 permits the user to easily align the cutting blade at the desired reference location. Additionally, attachment system 125 is fixed to the saw using a screw coupler 140. In other embodiments, it may be desirable to use a quick-release fastener (e.g., a quick release coupler or other well-known device) to maintain guide 110 cooperated with tool 105.

Figure 2:
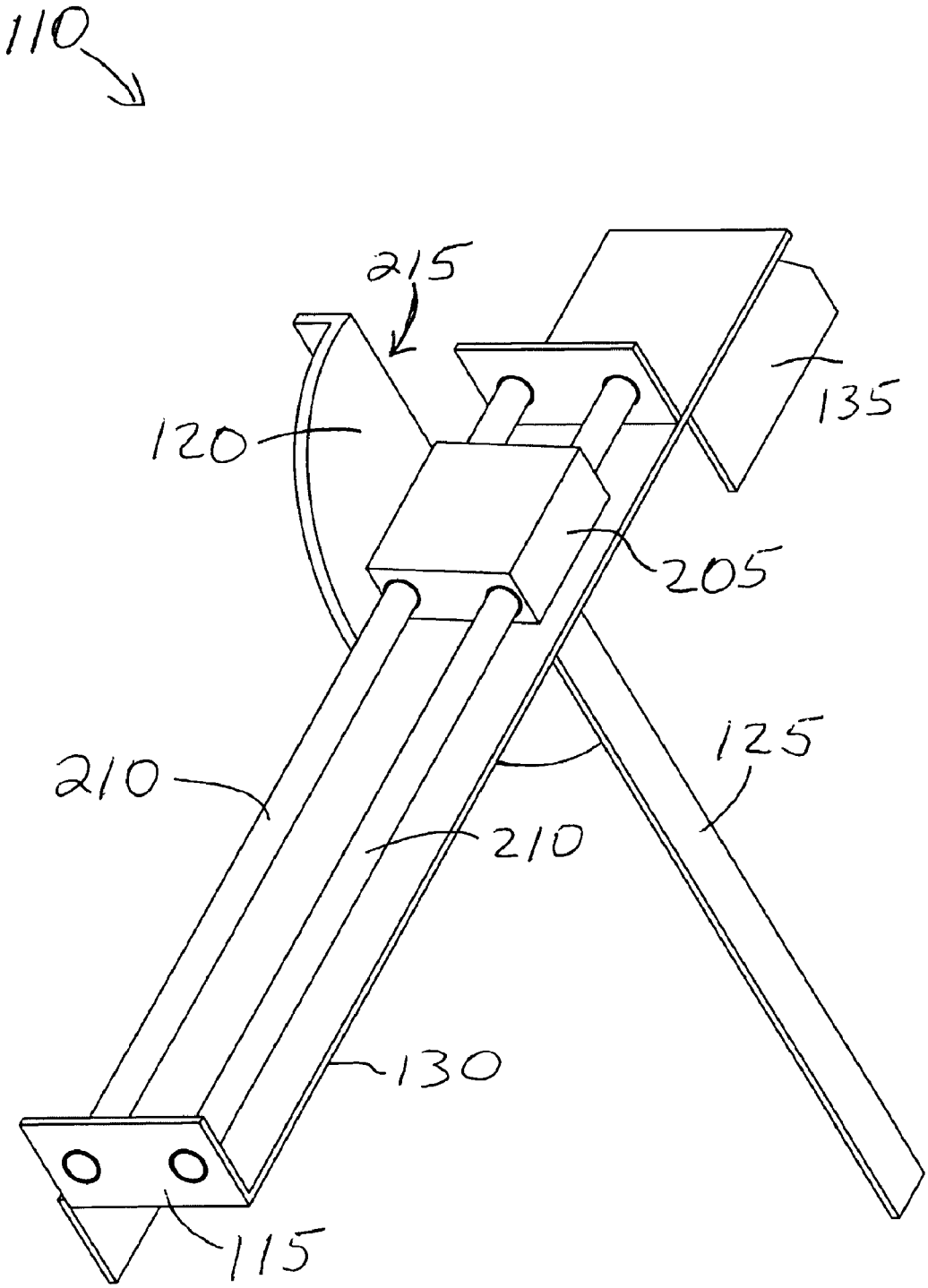
FIG. 2 is a perspective view of a guide shown in FIG. 1.

FIG. 2 is a perspective view of guide 110 shown in FIG. 1. As discussed above, guide 110 includes three major components. Guiding subsystem 115 includes housing 130 supporting a guide element 205 that moves along a pair of guide rails 210 supported by housing 130. Guide element 205 moves along a processing path defined by guide rails 210 from a first position near one end of housing 130 to a second position near another end of housing 130. As shown, guide rails 210 are mounted in housing 130 so guide element 205 moves linearly from the first position to the second position (though other embodiments may define a different path) throughout an entire range of motion of guide element 205. In alternate embodiments, the processing path may be defined/constrained by an alternate suitable structure.

Workpiece coupler 120 is attached to guide element 205 and moves along the processing path throughout the range of motion. Coupler 120 includes a mating face 215 that permits simple contact to an edge of the workpiece across sufficient surface area that the user is able to know when the entire face of mating face 215 is flush and flat against the workpiece.

Mating face 215 is set to define an angle relative to the plane containing the processing path, this angle is referred to as the processing angle. In the preferred embodiment, this angle is fixed at about ninety degrees. However, in other applications, other or additional processing angles may be provided. Conveniently for implementations having multiple angles, the connection between coupler 120 and guide element 205 is variable and most preferably includes detents to permit accurate and quick selection of desired preset angles. For example, in some instances angles of thirty degrees and forty-five degrees are useful. In some applications, mating face 215 is provided with high-friction materials (relative to the intended workpiece or types of workpieces) or provided with tiny "teeth" to secure mating face 215 up against the workpiece during the range of motion. As the processing angle decreases, it sometimes becomes more difficult to maintain cutting system 100 in the proper relationship to the workpiece by holding the workpiece and power tool in different hands. It is a feature of the preferred embodiments that precise cutting at the desired location at the desired angle is achieved without attaching a clamp or other structure to the workpiece to define the processing path.

Attachment system 125, as discussed above, is sized to engage the standard rip-guide retaining slot provided on most standard circular saws. This retaining slot is defined to be perpendicular to the plane of the cutting blade. Other power tools may have different arrangements or require an adapter to mate to the saw to secure/hold/engage attachment system 125.

Attachment system 125 engages housing 130 at a right angle to the processing path. Thus when attachment system 125 also engages power tool 105, the linear path is parallel to the blade rotation plane of the saw through the range of motion of guide element 205.

Figure 3:
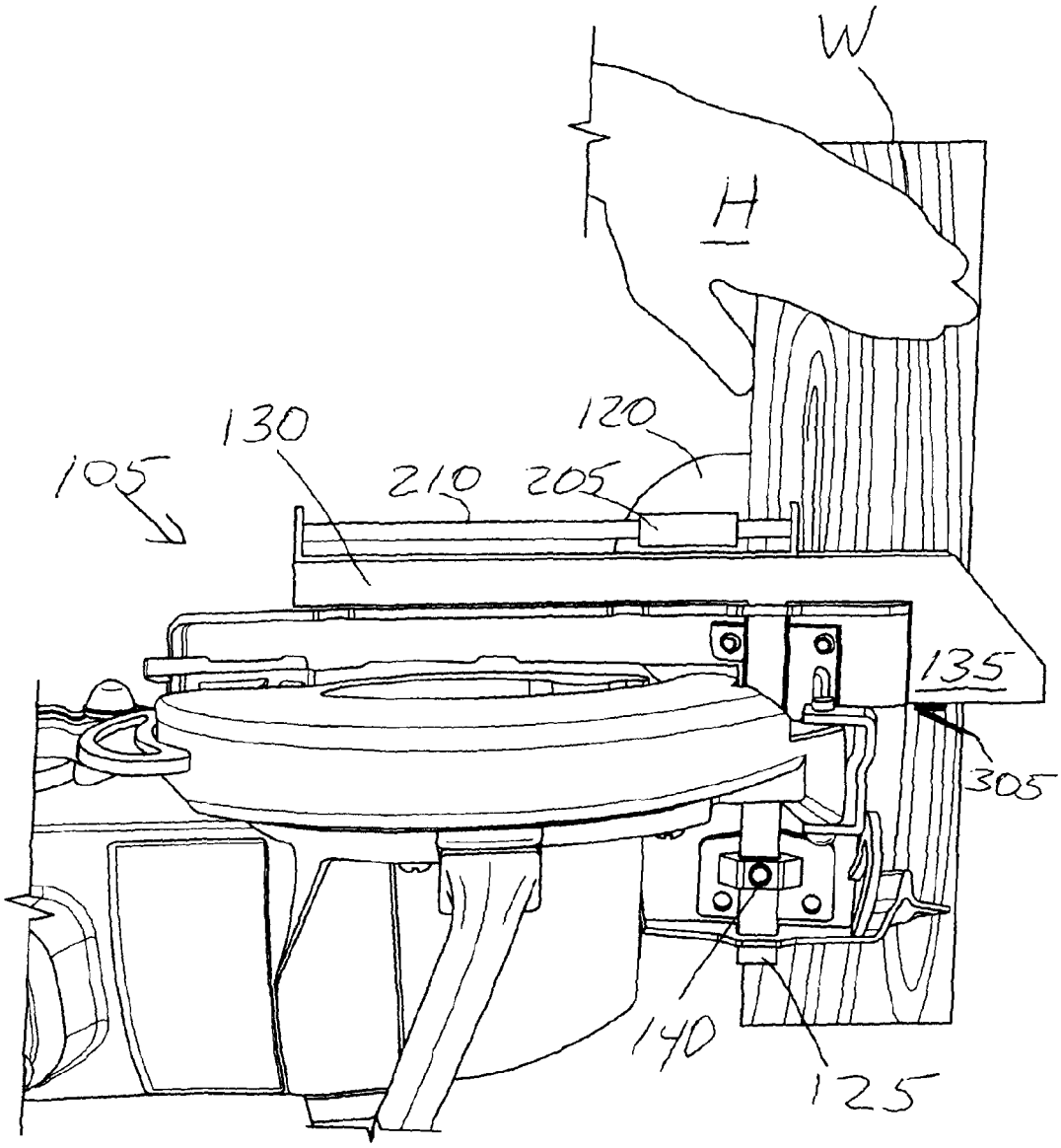
FIG. 3 is a top plan view showing the system of FIG. 1 used to cut a workpiece.

FIG. 3 is a top plan view showing the system of FIG. 1 used to cut a workpiece W held by a hand H of a user. The user aligns index 135 with a reference mark 305 (attachment system 125 extends into and retracts from the slot on saw 105 to align index 135 in the cutting plane of the rotating saw blade.) Thus, the saw blade is positioned laterally along the length of workpiece W at the proper location by aligning index 135 with reference mark 305.

Concurrently with aligning index 135 with reference mark 305, workpiece coupler 120 locates the cutting plane defined by the cutting blade at the proper angle with respect to the longitudinal axis of workpiece W. In the preferred embodiment, this angle is perpendicular as noted above.

As the user operates tool 105 to cut workpiece W, guide element 205 moves linearly along rails 210. Workpiece coupler 120 maintains the desired angle as guide element 205 moves along the processing path. Housing 130 moves over workpiece W and workpiece coupler 120 remains mated to the edge. The cutting plane of the blade, constrained to be parallel to the processing path with an angle defined by the angle between workpiece coupler 120 and the processing path, and with the cutting plane centered on the reference mark, ensure that workpiece W is efficiently and easily cut at the proper length at the proper angle.

The system above has been described in the preferred embodiment including a hand-held circular saw for efficiently cross-cutting framing materials such as 2×4s. In alternate preferred embodiments, angles other than ninety degrees may be specified and cut. Additionally, some embodiments include other hand-held power tools that process a workpiece while it is held in hand to direct a processing implement of the tool along a desired processing path.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures may also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A cross-cut apparatus comprising:

a guide system including a housing, a guide element, and a linear guide rail mounted on the housing for defining a processing path for said guide system as said housing moves from a first position to a second position and back to said first position relative to guide element;

a workpiece coupler, coupled to said guide element, defining a desired processing angle of the guide system with respect to a workpiece as said housing moves from said first position to said second position; and an attachment system, coupled to said housing, for fixing to a hand-held power processing tool to the guide system and to position the power processing tool at a reference location relative to said workpiece and at said desired processing angle;

wherein said processing path extends from a first edge of said workpiece to a second edge of said workpiece and wherein when the housing with the attachment system and the power processing tool is moving along said processing path, the workpiece is separated into two discrete detached subparts;

wherein said guide system includes a first arm and a second arm substantially perpendicular to said first arm, said first arm defining a L-shaped recess near a junction of said arms; wherein said recess receives said power processing tool; wherein the arms define the housing;

wherein said guide element is disposed on said second arm at a side of said second arm opposite of said L-shaped recess and receives the linear guide rail; and wherein said workpiece is held in one hand while said power-processing tool with said attachment system affixed, is held in a second hand and operated to process said workpiece.

2. The apparatus of claim 1 wherein said power processing tool is a circular saw, and wherein said processing path is a linear path starting from said reference location.

3. The apparatus of claim 2 wherein said workpiece is a piece of 2×4 construction framing lumber having a longitudinal axis extending in a longest dimension of said workpiece and said desired processing angle includes a substantially right angle relative to said longitudinal axis.

4. The apparatus of claim 1 wherein said attachment system includes a hand-operated tool-less quick release fastener to control said cooperation with said hand-held power tool.

5. The apparatus of claim 1 further comprising a referencing system, said referencing system including an index defined by an arm of said L-shaped recess for fixing said power processing tool at said desired reference location by locating said index at said reference location on said workpiece.

6. The cross-cut guide of claim 1 wherein said linear guide rail include a length and wherein said processing path is not greater than said length of said linear guide rail.

* * * * *